US005404969A

United States Patent [19]

Hoefsloot

[11] Patent Number: 5,404,969

[45] Date of Patent: Apr. 11, 1995

[54] FIRE DOOR FOR AN ELEVATOR

[75] Inventor: Leon Hoefsloot, Chaudfontaine, Belgium

[73] Assignee: Kone Elevator GmbH, Baar, Switzerland

[21] Appl. No.: 69,413

[22] Filed: Jun. 1, 1993

[30] Foreign Application Priority Data

Jun. 4, 1992 [FI] Finland ..... 922585

[51] Int. Cl.[6] ..... B66B 13/00

[52] U.S. Cl. ..... 187/326; 187/340; 49/31; 49/63

[58] Field of Search ..... 187/98, 51, 56, 57, 187/61, 62, 65; 49/1, 5, 8, 31, 61, 63; 169/48

[56] References Cited

U.S. PATENT DOCUMENTS

| | | | |
|---|---|---|---|
| 3,598,202 | 8/1971 | Kirsch et al. | 187/51 X |
| 5,156,237 | 10/1992 | Hayashi et al. | 187/51 X |
| 5,195,594 | 3/1993 | Allen et al. | 169/48 |

FOREIGN PATENT DOCUMENTS

| | | | |
|---|---|---|---|
| 479238 | 4/1992 | European Pat. Off. | 187/51 X |
| 479239 | 4/1992 | European Pat. Off. | 187/51 X |
| 3803317 | 8/1988 | Germany . | |
| 2-110097 | 4/1990 | Japan | 187/51 X |
| 2-295884 | 12/1990 | Japan | 187/51 X |
| 4-272086 | 9/1992 | Japan | 187/51 X |
| 2108839 | 5/1983 | United Kingdom | 169/48 X |

*Primary Examiner*—Robert P. Olszewski
*Assistant Examiner*—Dean A. Reichard

[57] ABSTRACT

Fire door for an elevator, especially for use in the landing doorways of an elevator shaft. The fire door is mounted abreast of an elevator landing door. The fire protection characteristics of the fire door are so chosen that the elevator door and the fire door together fulfil the requirements imposed on a fire door.

9 Claims, 2 Drawing Sheets

FIRE DOOR FOR AN ELEVATOR

BACKGROUND OF THE INVENTION FIELD OF THE INVENTION

The present invention relates to an elevator fire door especially for use in the landing doorways of elevator shafts.

Fire doors are normally used in the landing doorways of an elevator shaft to prevent the propagation of fire, thermal radiation and partly combustion gases from floor to floor through the elevator shaft during a fire.

Previously known are solutions in which every or almost every floor is provided with a separate fire door in addition to a landing door for the elevator shaft. In these solutions, the fire door is a completely separate structure from the landing door of the elevator shaft, which means that it occupies a large space and is expensive. There are also solutions in which the landing door of the elevator shaft also functions as a fire door. In this case, the door is very thick and a massive structure. Due to the large mass of the door, it is slow in operation. When the elevator is out of order, the landing door may remain open, in which case it provides no fire protection at all. A fire door of this type is described in DE publication 3803317.

SUMMARY OF THE INVENTION

An object of the present invention is to achieve a completely new type of fire door for elevator shafts. The invention is based on the idea that, on every or almost every floor, the landing doorway of the elevator shaft is provided with two parallel pairs of door leaves mounted on the same supporting element so that, as seen from the elevator shaft, the inner doors are normal landing doors of the elevator while the outer doors only function in a fire situation. These doors together fulfil the requirements imposed on a fire door. As compared with previously known solutions, the fire door of the invention has several advantages. The doors are arranged in a single door structure, which takes up less space than a structure in which, in addition to the landing door of the elevator shaft, there is a separate door that alone meets the requirements placed on a fire door. It is also easier to install. In case of malfunction, when the landing doors of the elevator are open, the fire door can be closed independently of the landing doors. In this way, the requirements are fulfilled, although for a shorter time. The arrangement according to the invention is safer because the movable door mass in normal elevator operation is smaller than when a massive landing door is used as a fire door. Therefore, the elevator also provides faster service than in the case of heavy doors, because light doors can be moved faster.

DESCRIPTION OF PREFERRED EMBODIMENTS

Figure 1:
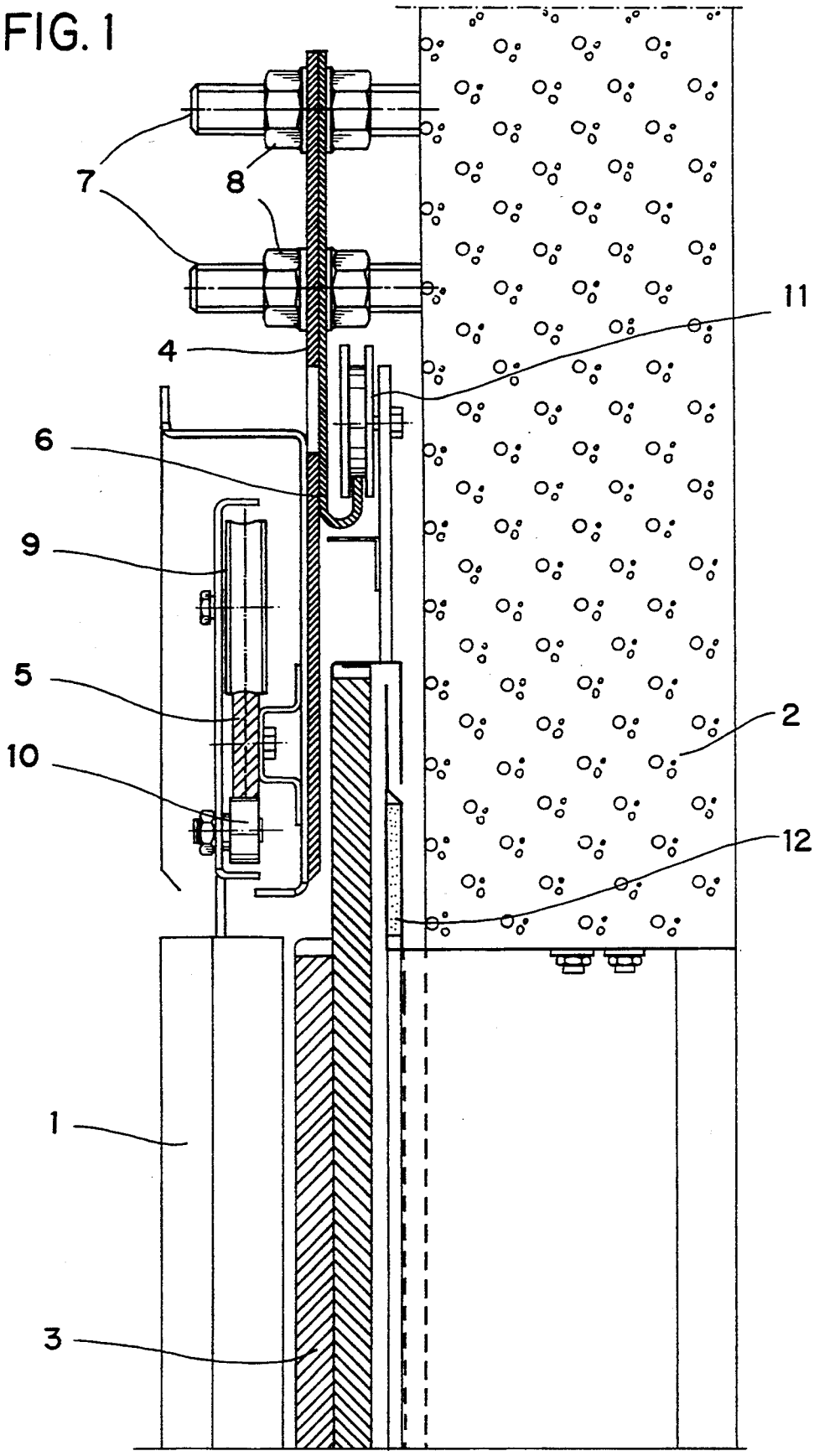
FIG. 1 illustrates the upper part of a fire door of the invention in lateral view, partly sectioned.

In the embodiment of FIG. 1, the fire door of the invention is presented in a partly sectioned side view. The fire door structure consists of the normal landing door 1 of the elevator and a fire door 3 mounted abreast of it. In the solution presented in FIG. 1, the fire door is placed between the landing door 1 and the wall 2 of the elevator shaft. This arrangement simplifies the door structure and allows easier placement of the operating mechanism of the landing door. In the case depicted in FIG. 1, the elevator shaft is to the left of the doors while the landing is to the right. The fire protection characteristics of the fire door 3, especially its thickness and/or insulating material, are so selected that the landing door 1 and the fire door 3 together fulfil the requirements imposed on a fire door.

The landing door 1 and the fire door 3 of the elevator are mounted on roller races 5, 6 or equivalent structure attached to a supporting element 4. The supporting element 4 is anchored in the wall 2 of the elevator shaft by means of mounting elements 7, 8. The supporting element 4 is preferably a plate arranged in a substantially vertical position and provided with a landing door roller race 5 or equivalent structure attached to one side of it and a fire door roller race 6 or equivalent structure attached to the other side. The roller races 5, 6 or equivalent structure are so mounted relative to each other that the fire door roller race 6 is higher up while the landing door roller race 5 is lower down as compared to each other. This door supporter structure makes it possible to use a thinner structure than before. Moreover, an overlapping supporter mechanism can be used and the door mechanism can be better protected. The upper edge of the fire door 3 protects the door mechanism. Thus, the door has a better ability to function after a fire situation. The doors in the figure are horizontally movable sliding doors opening at the middle. The landing door 1 is preferably arranged to move on the roller race 5 by means of roller elements 9, 10 provided at the upper part of the door. The landing doors 1 of the elevator are actuated by means of a known apparatus (not shown). The fire door 3 is arranged to move on the roller race 6 by means of one or more roller elements 11 provided at the upper part of the door.

FIG. 1 shows the suspension of only the upper parts of the doors. The lower parts of the doors are arranged to move e.g. by means of a guiding element in a groove which is preferably parallel to the corresponding roller race 5, 6.

Figure 3:
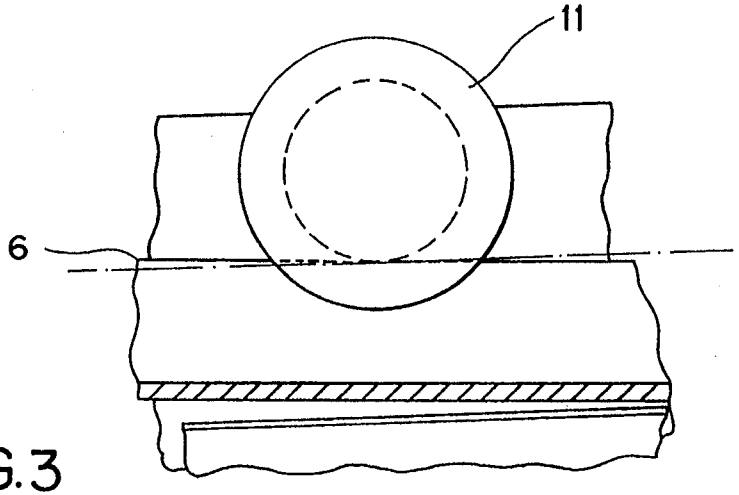

In a normal situation, the fire door 3 is open, the leaves 3*a*, 3*b* being locked in place e.g. by means of a latch (not shown in the figure). The latch is so arranged that it will release the door leaves in the event of a fire. One possibility is to connect the latches to a fire alarm apparatus so that they will operate in accordance with control commands received from the latter. Another advantageous application is to make the latch from a meltable material, in which case the door locking will be released when the temperature rises to a given value. U.S. Pat. No. 3,598,202 proposes some solutions for the control of an elevator door latch. The fire door 3 has an arrangement for automatic closing. In a preferred embodiment, the roller race 6 of the fire door 3 is mounted in a slanting position, as illustrated in FIG. 3 so that the door leaves 3*a*, 3*b* will gravitate towards the middle of the doorway, closing the fire door. In another preferred embodiment, the door leaves 3*a*, 3*b* are arranged to be closed by means of an actuating mechanism based on the use of a counterweight. In this case, when the latch releases the locking of the fire door, the counterweight causes the door leaves to close.

Figure 2:
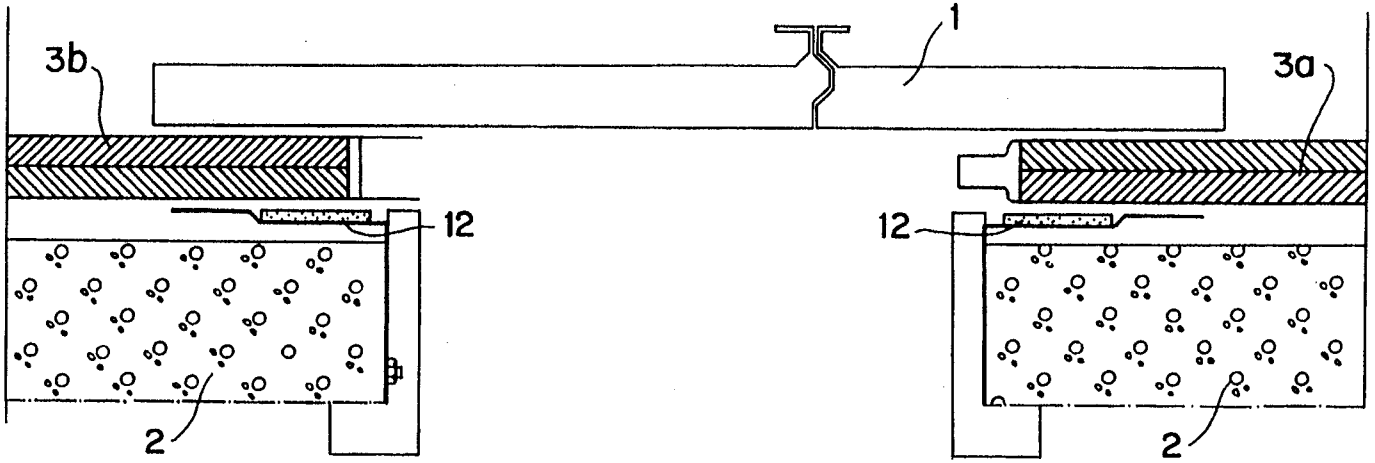
FIG. 2 illustrates the fire door of the invention in top view, sectioned and simplified.

The fire door includes structure whereby the junction between the two door leaves 3*a*, 3*b* is sealed in a fire situation. In the example illustrated by FIG. 2, door leaf 3*a* is provided with a male type joining element and the other door leaf 3*b* with a female type joining element. The joining elements of the door leaves fit into each other when the door is closed, thus sealing the juncture between the door leaves 3*a*, 3*b*.

The doorway is preferably surrounded by sealings 12 which in an embodiment of the fire door structure are so arranged that they will expand in a fire situation, preventing propagation of fire into the elevator shaft or equivalent through the space between the fire door 3 and the wall 2 of the elevator shaft.

The fire door of the invention can have a thinner structure than in previously known solutions. In itself, the door is a typical fire door with insulating material between its face plates.

It is obvious to a person skilled in the art that the invention is not restricted to the examples described above, but that it may instead be varied within the scope of the following claims.

I claim:

1. A fire door arrangement for an elevator, especially for use in landing doorways of an elevator shaft comprising:

a fire door mounted abreast of an elevator landing door with means for moving the fire door and the elevator landing door relative to each other;

the fire door having a first fire protection characteristic and the elevator landing door having a second fire protection characteristic, the fire protection characteristic of the elevator landing door being effective together with the fire protection characteristic of the fire door to fulfill a total fire protection characteristic of the fire door arrangement; and wherein the fire door is placed between the elevator landing door and a wall of an elevator shaft.

2. The fire door arrangement according to claim 1, further including roller races for the fire door and the elevator landing door; and the roller races being attached to the same supporting element.

3. The fire door arrangement according to claim 2 wherein the roller races are mounted relative to each other so that the roller race of the fire door is located higher up than the roller race of the elevator landing door.

4. The Fire door arrangement according to any one of claims 1 or 2 further including means separate from the elevator landing door for automatically closing the fire door.

5. The fire door arrangement according to claim 2, wherein said roller race of the fire door is mounted in a slanting position so that the fire door is closed by the force of gravitation.

6. The fire door arrangement according to claim 1 further including means separate from the elevator landing door for closing the fire door by force the fire door.

7. The fire door arrangement according to claim 2 wherein the supporting element is a plate arranged in a vertical direction; and the roller race of the fire door and the roller race of the elevator landing door are mounted on opposite sides of the plate.

8. The fire door arrangement according to claim 1, wherein the fire door includes two leaves and the elevator landing door includes two leaves; and a first leaf of the fire door includes a first means for interacting with a second means on the second leaf of the fire door for joining the leaves.

9. The fire door arrangement according to claim 8, wherein the means forms a joint.

* * * * *